US007565872B2

(12) United States Patent
Rippert et al.

(10) Patent No.: US 7,565,872 B2
(45) Date of Patent: Jul. 28, 2009

(54) DOUBLE CHAIN STITCH SEWING MACHINE

(75) Inventors: Jörg Rippert, Zwingenberg (DE); Robert Keilmann, Bensheim (DE)

(73) Assignee: KSL Keilmann Sondermaschinenbau GmbH, Lorsch (DE)

( * ) Notice: Subject to any disclaimer, the term of this patent is extended or adjusted under 35 U.S.C. 154(b) by 0 days.

(21) Appl. No.: 11/814,288

(22) PCT Filed: Jan. 27, 2006

(86) PCT No.: PCT/EP2006/050496

§ 371 (c)(1),
(2), (4) Date: Jul. 19, 2007

(87) PCT Pub. No.: WO2006/079657

PCT Pub. Date: Aug. 3, 2006

(65) Prior Publication Data

US 2008/0173221 A1 Jul. 24, 2008

(30) Foreign Application Priority Data

Jan. 28, 2005 (DE) ..... 10 2005 004 124

(51) Int. Cl.
*D05B 1/10* (2006.01)
*D05B 57/00* (2006.01)

(52) U.S. Cl. ..... 112/165

(58) Field of Classification Search ..... 112/197, 112/199, 200, 187, 227, 39, 40
See application file for complete search history.

(56) References Cited

U.S. PATENT DOCUMENTS 712,852 A * 11/1902 Rontke ..... 112/165
2,310,320 A * 2/1943 Rubel ..... 112/227
2,669,206 A 2/1954 Pinkvoss et al.
4,285,291 A * 8/1981 Ackermann et al. ..... 112/184
4,438,717 A 3/1984 Minella et al.
4,757,774 A 7/1988 Junemann
4,791,875 A 12/1988 Ackermann
4,970,977 A 11/1990 Motta
5,540,162 A * 7/1996 Schopf et al. ..... 112/220
6,837,172 B1 1/2005 Chuo

OTHER PUBLICATIONS

International Search Report for PCT/EP2006/050496.

* cited by examiner

*Primary Examiner*—Ismael Izaguirre
(74) *Attorney, Agent, or Firm*—McCormick, Paulding & Huber LLP

(57) ABSTRACT

A double chain stitch sewing machine includes an upper section (10) and a lower section (12), which can be displaced synchronously parallel to a sewing product plane (14) The upper section includes a needle rod (18) holding a needle (20), and a drive (28) for displacing the needle rod perpendicularly to the sewing product plane. The lower section has a hook (40), which reciprocates in a plane parallel to the displacement direction of the needle rod and cooperates with the needle to form the stitch At least one needle stabilizer (42 or 44) in the lower section can be displaced synchronously with the needle rod and hook displacements between a first needle position close to the needle path, in which the needle stabilizer supports the needle against deflection transverse to the displacement path of the hook ,and a second position offset from the needle path.

11 Claims, 2 Drawing Sheets

DOUBLE CHAIN STITCH SEWING MACHINE

CROSS REFERENCE TO RELATED APPLICATIONS

Figure 1:
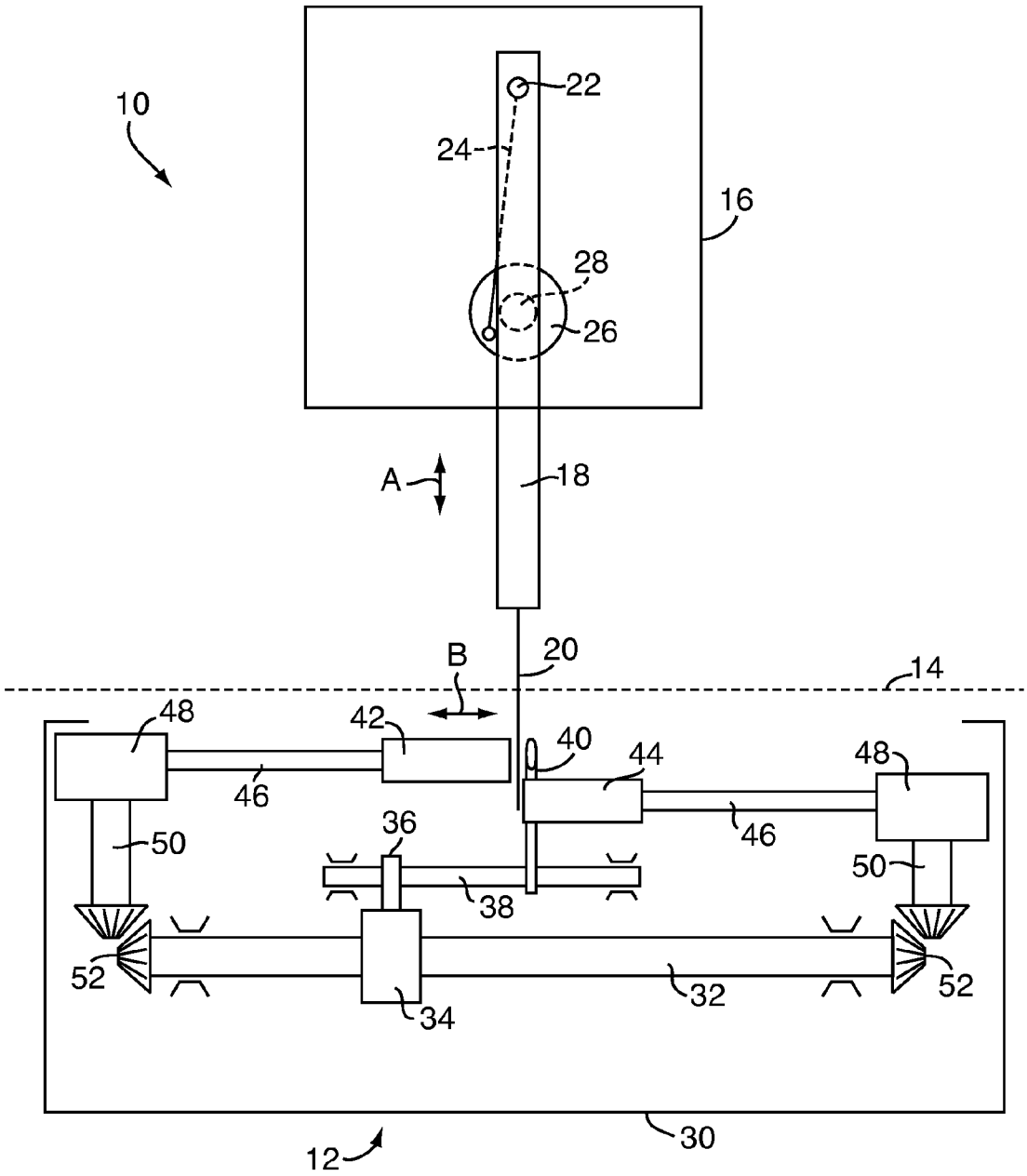

This application claims the benefit of PCT Application PCT/EP2006/050496, filed Jan. 27, 2006 and German Application No. 102005004124.8. filed Jan. 28, 2005, the disclosures of which are herein incorporated by reference in their entirety.

BACKGROUND OF THE INVENTION

The invention concerns a double chain stitch sewing machine with a machine upper section and a machine lower section which sections between themselves define a sewing product plane parallel to which plane the machine sections are movable in synchronism, with the machine upper section having a needle rod for holding a needle and movable by a drive perpendicularly to the sewing product plane and the machine lower section having a hook cooperating with the needle for forming stitches, which hook is movable back and forth in a plane parallel to the movement direction of the needle rod.

Double chain stitch sewing machines of the aforementioned kind in which a machine upper section and a machine lower section are rigidly connected with one another have been known for decades. Moreover, machines of the above mentioned kind have also been known in which a machine upper section and a machine lower section are mechanically separated from one another or at least are not directly connected with one another, but by way of synchronously controlled drives have been capable of being driven in common along the sewing product plane. Such machines have been used for example for the sewing of quilts or mattress covers. Also common are previously known double chain stitch sewing machines in which the sewing direction is predetermined by the construction of the sewing machine. For example, in the sewing of mattress covers the sewing product web is pulled from a supply roll, and therefore in the case of a change in the direction of the sewing the machine upper section and the machine lower section must be rotated in common into the new sewing direction, since the sewing product itself cannot be rotated. In connection with this it is known to rotatably support the machine upper section and the machine lower section about the needle axis. This rotation of the machine upper section and machine lower section requires an additional drive and a corresponding control. Moreover, at each change of direction the sewing drive must be braked and subsequently again accelerated.

SUMMARY OF THE INVENTION

The invention has as its basic object the provision of a double chain stitch sewing machine of the previously mentioned kind wherein the sewing direction is not fixed relative to the machine upper section and the machine lower section, so that therefore one can sew in any desired direction without turning the machine upper and lower sections into the new sewing direction.

This object is solved in accordance with the invention in that in the machine lower section at least one needle stabilizer is arranged which is movable in synchronism with the needle rod movement and the hook movement between a first position near the needle path in which it supports the needle as it plunges into the sewing product against a deflection laterally to the movement path of the hook, and a second position remote from the needle path.

The double chain stitching requires that the upper thread plunges into the loop formed by the hook upon the rising of the needle, and that as another thing the needle upon its penetration into the sewing product passes through the thread triangle of the lower thread. If either of these two requirements is not filled stitching faults appear. Moreover, the needle and hook cannot be allowed to collide, since otherwise the needle is damaged. Because of the mentioned reasons, it was previously not possible, at least with rapidly moving sewing machines of the previously mentioned kind, to move the sewing product and sewing machine relative to one another in a direction deviating from the predetermined sewing direction. In the case of the solution of the invention the needle stabilizer now provides for holding the needle and hook, at the critical moments of the stitch creation, in their desired positions and for not permitting the needle to deflect laterally of the movement path of the hook beyond an acceptable amount. Accordingly, the sewing machine can also be moved at high sewing speeds laterally to the movement path of the hook without the danger existing that the needle is not displaced by the sewing product too far from the hook or that it will collide with the hook. This makes it possible to change the sewing direction of the sewing machine relative to the sewing product at will without the sewing machine having to be rotated into the new sewing direction.

Preferably two needle stabilizers are so arranged relative to one another that they move oppositely between their first and second positions so that between themselves they limit the path for the needle. The one or each one of the two needle stabilizers can for example be moved linearly back and forth by an eccentric drive.

Preferably the needle stabilizers are displaced from one another in the movement direction of the needle rod with the needle stabilizer arranged on the side of the needle facing away from the hook being located closer to the sewing product plane. On one hand, the one needle stabilizer can thereby be withdrawn from the hook path so that it does not hinder the hook. On the other hand, the needle immediately after its escape from the underside of the sewing product can be supported by the other needle stabilizer.

Along with the supporting function, the needle stabilizer which is arranged on the side of the needle facing away from the hook, also has the effect that the upper thread is pressed into the needle eye so that the thread loop which it forms, and through which the hook is to enter, is opened to a maximum amount.

To hinder movement of the needle not only laterally of the movement path of the hook, but also in regard to the movement parallel to the movement path of the hook, it is advantageous to provide in the supporting surfaces of each needle stabilizer facing the needle a flat groove for the needle running parallel to the needle movement direction.

In order to maximally open the thread triangle formed by the hook with the lower thread for the entry of the needle, it is known to provide a so called loop spreader which synchronously with the needle movement and hook movement takes hold of the lower thread and holds the thread triangle until the needle has passed through it. One such solution is for example described in German Laid Open Document 21 08 309. In it the loop spreader is movable in a back and forth direction. So that the thread triangle of the lower thread is continuously held open also in the case of a change in the sewing direction, in the solution of the invention a loop spreader is provided in the machine lower section which is movable in synchronism with the needle movement and the hook movement in two directions in a plane parallel to the sewing product plane. The control of the loop spreader can for example be so accomplished that the loop spreader is connected to an eccentric drive and its movement path is determined by a guide piece.

Preferably the loop spreader is not, as previously, of pin shaped design, but instead is of fork shape so that it has two tines for taking hold of the lower thread.

To have more time for the stitch formation, it is advantageous if the needle dwells for the longest possible time in the vicinity of its lower dead point. If the needle rod is driven by a single motor, this can be achieved by a corresponding control of the motor. If the needle rod in a customary way is driven by an eccentric it is proposed in accordance with the invention that the needle rod is connected with the eccentric crank arm in such a way that the joint point of the crank arm to the needle rod lies on the side of the eccentric opposite from the needle point. This solution has the effect that the needle point remains at its lower dead point throughout a larger rotational angle of the drive shaft.

BRIEF DISCRIPTION OF THE DRAWINGS

Further features and advantages of the invention will be apparent from the following description which explains the invention by way of an exemplary embodiment in association with the accompanying drawings.

Figure 2:
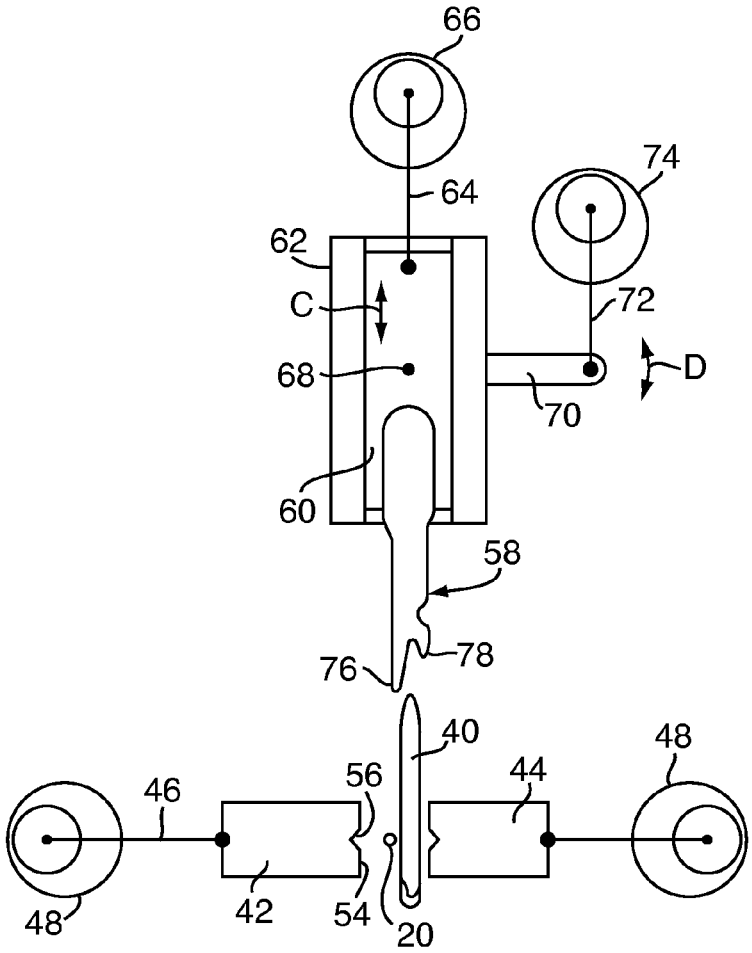
Figure 3:
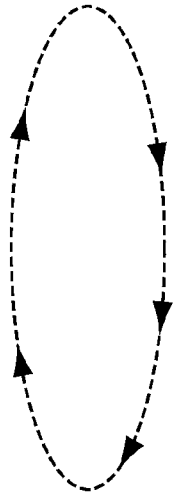

FIG. 1 is a schematic illustration of the double chains stitch sewing machine of the invention taken in a viewing direction parallel to the sewing product plane, FIG. 2 is a schematic plane view of the sewing machine lower section perpendicular to the sewing product plane with the most important functional elements, and FIG. 3 is a schematic illustration of the movement path of the loop spreader.

DETAILED DISCRIPTION OF THE PREFERRED EMBODIMENTS

The double chain stitch sewing machine of the invention includes an upper machine section indicated generally at 10 and a machine lower section indicated generally at 12, which sections between themselves define a sewing product plane 14 indicted by the broken line, in which plane, for example, is held a web of sewing product. The machine upper section 10 and machine lower section 12 are each arranged on a non-illustrated frame which is so designed that the machine upper section 10 and the machine lower section 12 can be moved in all directions in a plane parallel to the sewing product plane 14, with the drives necessary for this being mechanically or electronically couplable so that the movements of the two machine sections 10 and 11 occur in exact synchronism with one another.

The sewing machine upper section includes a housing 16 in which a needle rod 18 is guided for up and down movement in the direction of the double arrow A. The needle rod 18 carries a sewing needle 20 and near its upper end is connected by a joint 22 with one end of a crank arm 24 whose other end is pivotally connected to an eccentric 28 which is driven by a drive shaft 28. Because of the fact that the joint 22 of the crank arm lies on the opposite side of the eccentric 26 from the point of the needle there results in the vicinity of the lower dead point of the needle rod movement a relatively flat movement curve. That means, the needle point during a predetermined angular rotation of the drive shaft 28 remains near the lower dead point, so that in comparison to customary designs more time is available for the correct stitch formation. The machine lower section includes a housing 30 in which a drive shaft 32 is supported and is driven by a non-illustrated motor. The drive shaft 32 by way of an eccentric 34 and a swinging lever 36 drives a hook shaft 38 which is directed parallel to the drive shaft 32 and is fastened to a hook 40 which cooperates with the needle 20. The hook accordingly moves in a plane parallel to the movement direction of the needle 20 and perpendicular to the viewing plane of FIG. 1. The machine lower section as so far described is known in itself and therefore need not be explained in more detail.

In accordance with the invention two needle stabilizers 42 and 44 are provided in the machine lower section 12 and are guided in the housing 30 for back and forth movement in the direction of the double arrow B. Each of the stabilizers 42 and 44 is connected with an eccentric 48 through a rod 46, which eccentric 48 is driven by a shaft and a bevel gear drive 52 from the drive shaft 32. Thus, the needle stabilizers 42 and 44 can be moved between a first position, illustrated in FIG. 1, in which they support the needle 20 against a deflection perpendicular to the movement path of the hook 40, that is in the direction of the double arrow B, and a second position, illustrated in FIG. 2 in which they are spaced from the needle position.

As can be seen in FIG. 1, the two needle stabilizers 42 and 44 are displaced relative to one another perpendicularly to the sewing product plane, that is the needle stabilizer 44 is positioned lower than the stabilizer 42. Accordingly the needle stabilizer 44 can still support the needle 20 when the hook 40 with its point already dips into the upper thread loop. Only thereafter is the needle stabilizer 44 withdrawn to its second position, so that the pivoting movement of the hook 40 is no longer hindered.

As seen in FIG. 2, in the support surface 54 of each needle stabilizer 42, 44, facing the needle 20 is formed a flat groove 56 into which the needle 20 enters when the needle stabilizers 42 and 44 are in their first positions. In this way, the needle 20 is also inhibited from undertaking an unreliable deflection parallel to the movement path of the hook 40. Thereby by means of the needle stabilizers 42 and 44, the needle can be held in a predetermined position relative to the path of the gripper 40 so that a reliable stitch creation is assured and it is avoided that the needle 20 collides with the hook 40, indeed independently of in which direction it is held straight and in which deflecting forces are exerted on the needle 20 by the sewing product.

FIG. 2 shows a loop spreader 58 fastened to a slide 60 moveable in a carrier 62 moveable back and forth in straight-line fashion in the direction of the double arrow C. The slide 60 is connected with a first eccentric 66 through a crank arm 64. The carrier 62 itself is supported for pivotal movement about an axis 68 and can be pivoted back and forth (arrow D) by a second eccentric 74 about the axis 68 through a lever 70, rigidly connected with the slide, and a crank arm 72. The resultant movement of the free end of the spreading finger 58 is schematically illustrated in FIG. 3, with the shape of the nearly elliptical movement path being capable of being changed, since the eccentricity of each of the two eccentrics 66 and 74 are adjustable independently of one another.

The free end of the loop spreader 58 is of fork shaped design with a long finger 76 and a short finger 78. In the groove between the two fingers 76 and 78 the lower thread is caught. The loop spreader 58 displaces the lower thread to the side, that is it tensions the thread triangle of the lower thread so that the needle can plunge into the triangle. At the same time, the long finger 76 holds the thread loop of the upper thread hanging on the hook securely on the hook until the needle has been inserted into the thread triangle of the lower thread so that the needle without mistake moves into the thread loop of the upper thread. In this way, a reliable stitch formation is assured independently of the movement direction of the sewing machine relative to the sewing product web.

The invention claimed is:

1. A double chain stitch sewing machine with a machine upper section (10) and a machine lower section (12), which sections between themselves define a sewing product plane (14) and are moveable in synchronism parallel to said plane, the machine upper section (10) having a needle rod (18) movable perpendicularly to the sewing product plane (14) for holding a needle (20) and the machine lower section (12) having a hook (40) cooperating with the needle (20) for forming stitches, which hook is movable back and forth in a plane parallel to the movement direction of the needle rod (18), characterized in that at least one needle stabilizer (42, 44) is arranged in the lower machine section (12) and is movable in synchronism with the needle rod movement and the hook movement between a first position near the needle path, in which first position it supports the needle (20) plunging into the sewing product against a deflection laterally to the movement path of the hook (40), and a second position remote from the needle path, and further characterized in that a loop spreader (58) provided in the machine lower section (12) is movable in a plane parallel to the sewing product plane (14) in two directions in synchronism with the needle rod movement and the hook movement, the loop spreader (58) being guided for slidable linear movement in a guide piece (60) and being connected with a first eccentric drive (66), the guide piece (60) being pivotal back and forth about a pivot axis (68) by a second eccentric drive (74).

2. A double chain stitch sewing machine according to claim 1, further characterized in that the needle stabilizer (42, 44) is movable linearly back and forth by an eccentric drive (48).

3. A double chain stitch sewing machine according to claim 1 further characterized in that two needle stabilizers (42, 44) are arranged relatively to one another so that they are movable in opposite directions between their first and second positions.

4. A double chain stitch sewing machine according to claim 3 further characterized in that the needle stabilizers (42, 44) are displaced from one another in the movement direction of the needle rod (18), with the needle stabilizer (42) arranged on the side of the needle (20) facing away from the hook (40) lying closer to the sewing product plane (14).

5. A double chain stitch sewing machine according to claim 1 further characterized in that the support surface (54) of each needle stabilizer (42, 44) facing the needle (20) is formed with a flat guide groove (56) for the needle (20) running parallel to the needle movement direction.

6. A double chain stitch sewing machine according to claim 1 further characterized in that the loop spreader (58) is of fork shaped design.

7. A double chain stitch sewing machine with a machine upper section (10) and a machine lower section (12), which sections between themselves define a sewing product plane (14) and are moveable in synchronism parallel to said plane, the machine upper section (10) having a needle rod (18) movable perpendicularly to the sewing product plane (14) for holding a needle (20) and the machine lower section (12) having a hook (40) cooperating with the needle (20) for forming stitches, which hook is movable back and forth in a plane parallel to the movement direction of the needle rod (18), characterized in that at least one needle stabilizer (42, 44) is arranged in the lower machine section (12) and is movable in synchronism with the needle rod movement and the hook movement between a first position near the needle path, in which first position it supports the needle (20) plunging into the sewing product against a deflection laterally to the movement path of the hook (40), and a second position remote from the needle path, and further characterized in that the needle rod (18) is connected with an eccentric (26) through a crank arm (24) so that the joint point (22) of the crank arm (24) on the needle rod (18) lies on the side of the eccentric opposite from the needle point.

8. A double chain stitch sewing machine according to claim 7, further characterized in that the needle stabilizer (42, 44) is movable linearly back and forth by an eccentric drive (48).

9. A double chain stitch sewing machine according to claim 7, further characterized in that two needle stabilizers (42, 44) are arranged relatively to one another so that they are movable in opposite directions between their first and second positions.

10. A double chain stitch sewing machine according to claim 9, further characterized in that the needle stabilizers (42, 44) are displaced from one another in the movement direction of the needle rod (18), with the needle stabilizer (42) arranged on the side of the needle (20) facing away from the hook (40) lying closer to the sewing product plane (14).

11. A double chain stitch sewing machine according to claim 7, further characterized in that the support surface (54) of each needle stabilizer (42, 44) facing the needle (20) is formed with a flat guide groove (56) for the needle (20) running parallel to the needle movement direction.

* * * * *